US008839648B2

(12) United States Patent
Je et al.

(10) Patent No.: US 8,839,648 B2
(45) Date of Patent: Sep. 23, 2014

(54) DRAWER OF A WASHING MACHINE

(75) Inventors: Byoung Soo Je, Seoul (KR); Dong Won Kim, Kwangmyung-si (KR)

(73) Assignee: LG Electronics Inc., Seoul (KR)

( * ) Notice: Subject to any disclaimer, the term of this patent is extended or adjusted under 35 U.S.C. 154(b) by 1449 days.

(21) Appl. No.: 11/858,307

(22) Filed: Sep. 20, 2007

(65) Prior Publication Data

US 2008/0072631 A1 Mar. 27, 2008

(30) Foreign Application Priority Data

Sep. 25, 2006 (KR) ..... 10-2006-0093121

(51) Int. Cl.
*D06F 29/00* (2006.01)
*D06F 39/02* (2006.01)

(52) U.S. Cl.
CPC ..... *D06F 39/02* (2013.01)
USPC ..... 68/17 R

(58) Field of Classification Search
CPC ..... D06F 39/02; D06F 39/022
USPC ..... 68/17 R, 212
See application file for complete search history.

(56) References Cited

U.S. PATENT DOCUMENTS 1,365,523 A * 1/1921 Meilink ..... 312/334.12
2,200,319 A * 5/1940 Zalkind ..... 312/261
2,548,533 A * 4/1951 Hendricks ..... 312/246
2,997,355 A * 8/1961 Preble ..... 312/334.18
3,744,646 A * 7/1973 Duncan et al. ..... 211/162
3,857,618 A * 12/1974 Hagen et al. ..... 384/18
5,536,083 A * 7/1996 Brustle et al. ..... 312/334.6
2006/0261717 A1* 11/2006 Chirumbolo ..... 312/333

FOREIGN PATENT DOCUMENTS

DE 10061155 A1 6/2002
EP 1403415 A2 3/2004
EP 1449952 A1 * 8/2004
KR 10-2007-0059437 A 6/2007
KR 10-1203568 B1 11/2012
WO WO 03/044256 5/2003

OTHER PUBLICATIONS

International Search Report dated Oct. 22, 2010.
Korean Notice of Allowance dated Jul. 15, 2013 issued in Application No. 10-2006-0093121.

* cited by examiner

*Primary Examiner* — David Cormier
(74) *Attorney, Agent, or Firm* — KED & Associates, LLP

(57) ABSTRACT

A washing machine comprising a dispenser having an opening, a detergent box movable within the dispenser through the opening and having flange parts provided at corresponding sides of the detergent box in a movement direction of the detergent box, and guide units, provided on inner surfaces of respective side parts of the dispenser, to movably support the flange parts when the detergent box is withdrawn or inserted.

11 Claims, 11 Drawing Sheets

DRAWER OF A WASHING MACHINE

BACKGROUND

1. Field

One or more embodiments described herein relate to machines or appliances that perform a washing function.

2. Background

Traditionally, washing machines are equipped with a washing bath for holding wash water and laundry and a motor for rotating the washing bath. Washing machines also have a water supplying unit for supplying water to the washing bath and a water discharging unit for discharging wash water from the bath. In addition, a detergent supplying unit may be used to supply detergent to the washing bath, and typically has a dispenser for receiving detergent from a detergent box.

Related-art washing machines have a number of drawbacks. For example, they are complicated to use because a user is required to withdraw the detergent box from the dispenser, manually input detergent into the box, and insert the box back into the dispenser. This has proven to be cumbersome, especially because the detergent supply box has a tendency to become completely disengaged from the washing machine. Related-art detergent boxes are also difficult to use because of frictional forces, and because of this friction they often generate unpleasant noise when withdrawn from or inserted into the dispenser.

BRIEF DESCRIPTION OF THE DRAWINGS

The embodiments will be described in detail with reference to the following drawings in which like reference numerals refer to like elements wherein.

DETAILED DESCRIPTION

Figure 1:
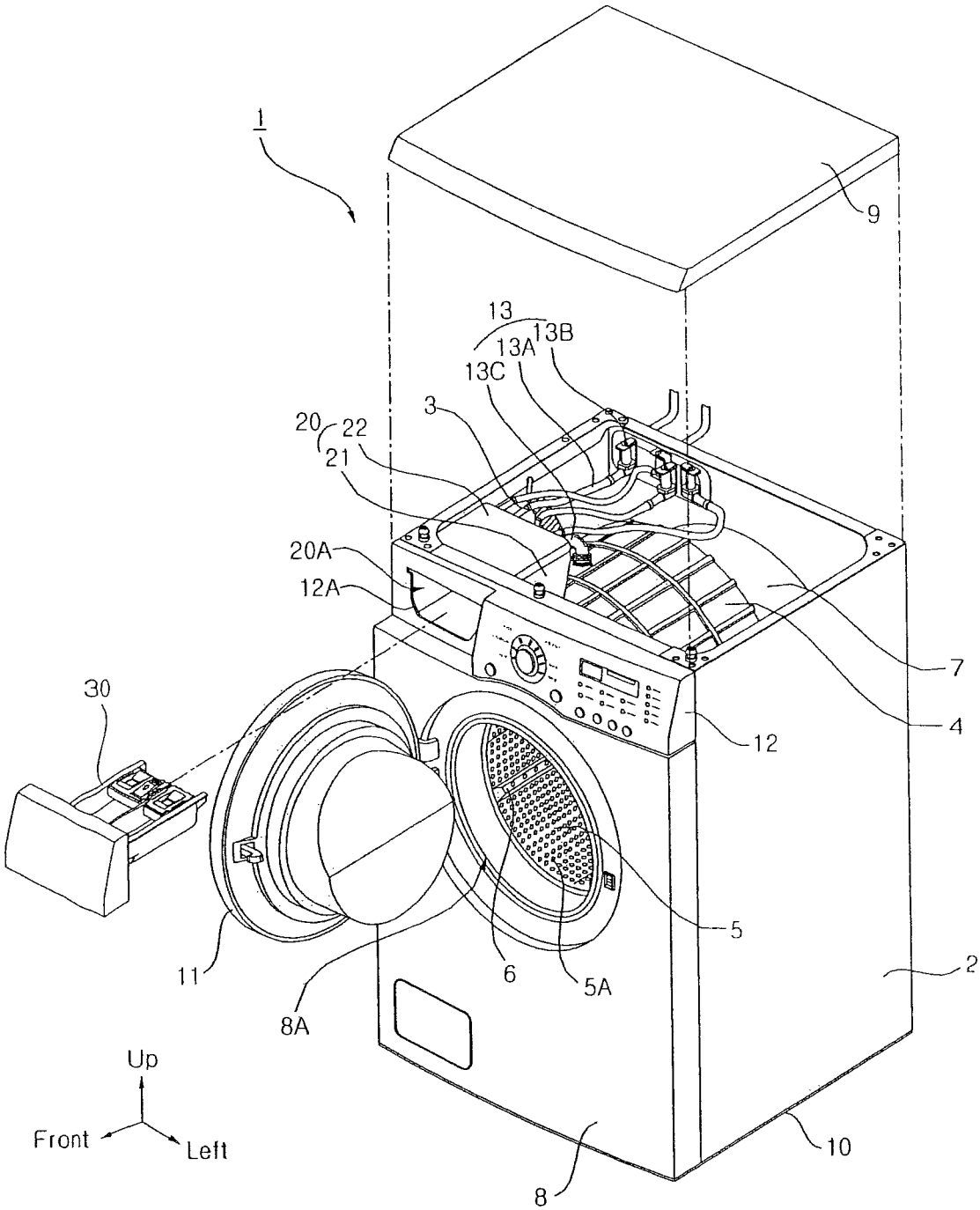
FIG. 1 is a partial exploded perspective view of one embodiment of a drum type washing machine.

Referring to FIG. 1, a drum-type washing machine 1 includes a cabinet 2, a tub 4, a drum 5, a lifter 6, and a driving unit 7. The cabinet has left, right, and rear surfaces. The tub retains water and is provided inside the cabinet and is dampened by a spring 3 and a damper (not shown). The drum is rotatably provided inside the tub for retaining laundry, and has a plurality of water holes 5A for allowing passage of wash water. The lifter is provided inside the drum to draw up and then drop down the wash water at a predetermined height within the drum. And, the driving unit is provided to apply a rotary force to the drum.

Also included is a cabinet cover 8 having a laundry opening 8A at its center, and a top plate 9 and base 10 are provided on upper and lower surfaces of the cabinet respectively. A door 11 is rotatably provided at the cabinet cover to open and close the laundry opening 8A. A control panel 12, provided at an upper side of the cabinet cover, displays and controls operation of the washing machine.

The washing machine also includes a water discharging unit (not shown) and a water supplying unit 13. The water discharging unit is provided between base 10 and tub 4 to discharge the wash water from the tub. The water supplying unit includes a water supply hose 13A, a water supply valve 13B, and a water supply bellows 13C. The water supplying unit is provided between top plate 9 and tub 4 to supplies water into the tub.

A detergent supplying unit 14 is provided on a water supply path of the water supplying unit 13 (FIG. 2), and operates to supply detergent to the tub with water. The detergent supplying unit connects between the water supply hose 13A and the water supply bellows 13C. The detergent supplying unit is mounted on cabinet 2 and cabinet cover 8 to allow a detergent box 30 to be withdrawn from and inserted into a doorway hole part 12A located at one side of the control panel.

Figure 2:
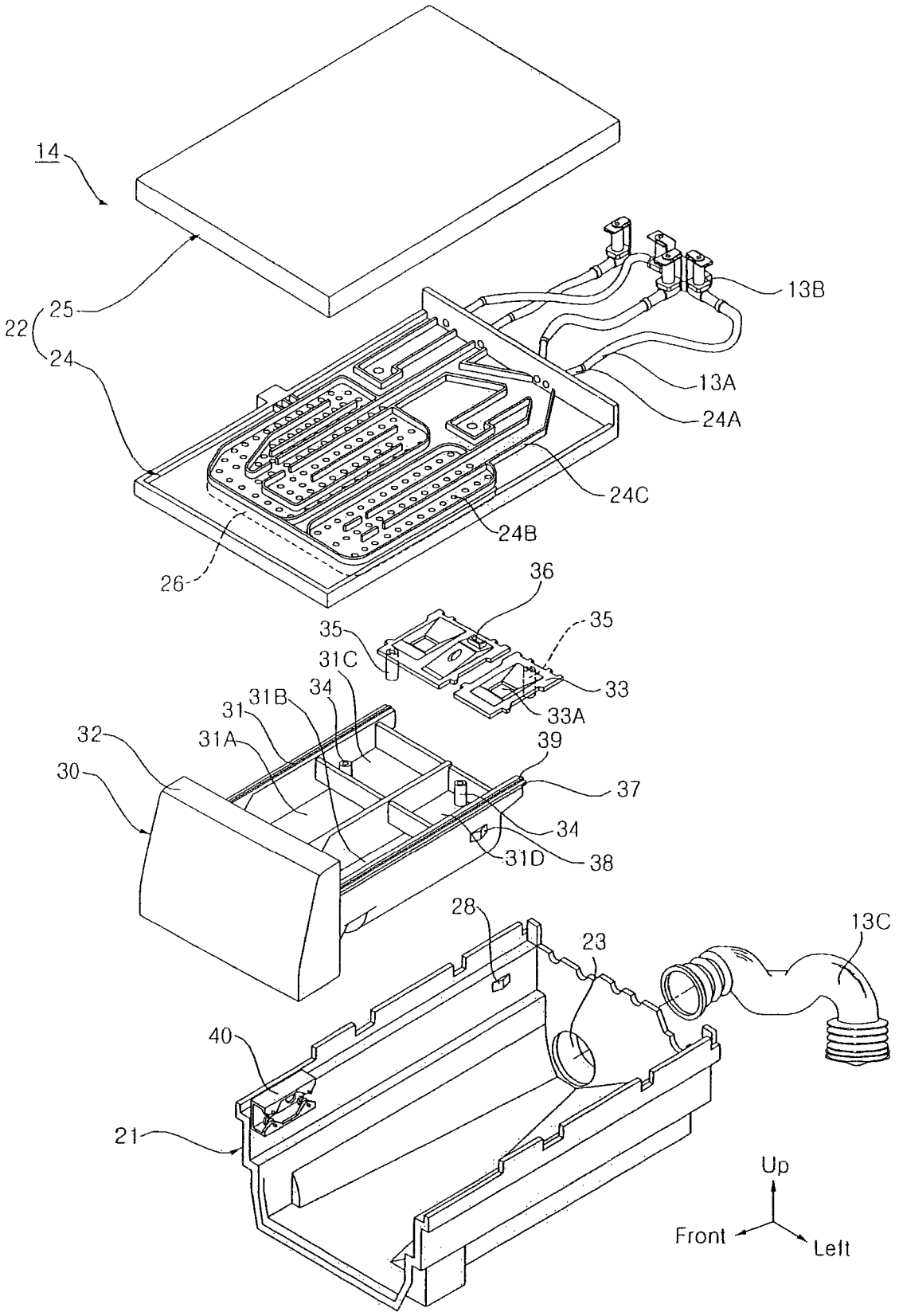
FIG. 2 is an exploded view of a detergent supplying unit shown in FIG. 1.
Figure 3:
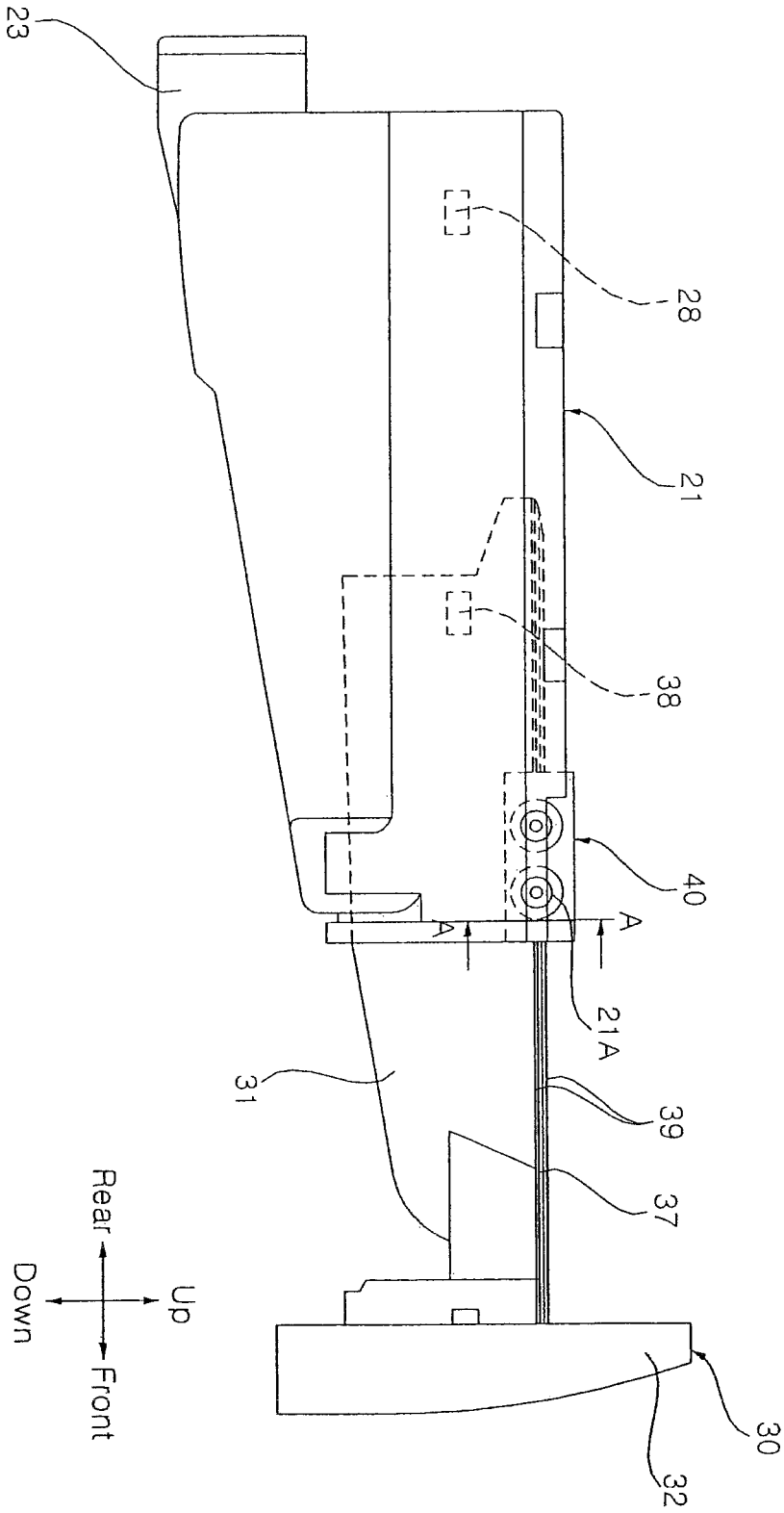
FIG. 3 is a side view of the detergent box and dispenser housing in FIG. 2.

Referring to FIGS. 1 to 3, the detergent supplying unit 14 includes a dispenser 20 connected to water supply hose 13A and water supply bellows 13C and is provided to communicate with a front opening 20A to the doorway hole part 12A of the control panel. Detergent box 30 is inserted into dispenser 20 and moves in a front and rear directions. The detergent box is withdrawn frontwardly via opening 20A of the dispenser and the doorway hole part 12A. The detergent box has flange parts 37 at both sides in a movement direction, and guide units 40 each provided at respective inner sides of the dispenser for movably supporting flange parts 37 when the detergent box is withdrawn or inserted.

The dispenser 20 includes a dispenser housing 21 to communicate with the doorway hole part 12A of the control panel. The housing is opened at a front side and an upper side, and a dispenser cover 22 is mounted at the opened upper side. The dispenser cover has water supply hole 24B for supplying water into detergent box 30.

The dispenser housing 21 also has a water discharge port 23 at a rear thereof and connects with the water supply bellows 13C. Water and detergent falling from the detergent box are supplied to the tub through the water supply bellows.

The dispenser cover 22 includes a bottom panel 24 mounted at the open upper side of the dispenser housing and a top panel 25 mounted on the bottom panel. Together, the top and bottom panels form a flow path. The bottom panel further includes a plurality of hose connecting parts 24A in a rear portion thereof, and connects with the water supply hose 13A. The bottom panel 24 has a plurality of water supply holes 24B for supplying water, with each hole provided at locations which correspond to detergent retaining parts of detergent box 30.

A flow path 24C is provided within top panel 25 and bottom panel 24, to guide water from the hose connecting parts 24A to the water supply holes 24B.

The detergent box 30 also includes a detergent box body 31 inserted into a space between the dispenser housing 21 and dispenser cover 22 such that it can be withdrawn frontwardly. The box has a plurality of detergent retaining parts 31A, 31B, 31C, and 31D for retaining detergent. In addition, a front panel 32 is provided in front of the detergent box body and a detergent box cap 33 is mounted on the detergent box body. The detergent box body may have a box shape which is open at upper and rear sides.

The plurality of detergent retaining parts 31A, 31B, 31C, and 31D are provided in the box body to retain detergent, and flange parts 37 are provided to movably support the box body by the guide unit 40. The first and second powder detergent retaining parts 31A and 31B are each provided in a front and/or rear direction at left and right sides of the detergent box body 31 for retaining powder detergent for washing and pre-washing. The bleacher retaining part 31C and softener retaining part 31D are provided at inner and rear sides of the first and second powder detergent retaining parts 31A and 31B, and are spaced a predetermined distance from a bottom for retaining bleacher and softener, respectively.

The first and second powder detergent retaining parts 31A and 31B are open at upper sides to allow powder detergent and/or water to be input, and are open at rear sides to discharge the powder detergent and/or water to the dispenser housing 21. The bleacher retaining part 31C and softener retaining part 31D are in positions spaced apart from each other a predetermined height from bottoms of the first and second powder detergent retaining parts. The bleacher and softener retaining parts may have box shapes open at upper sides to receive bleacher and softener. The bleacher and softener retaining parts may also have siphon pipes 34, protruding up from their bottoms, to communicate with spaces below the bleacher retaining part 31C and the softener retaining part 31D.

The front panel 32 may be provided in front of the doorway hole part 12A and have a same or similar structure as control panel 12. The front panel forms a front surface of the drum-type washing machine together with the control panel and cabinet cover. Detergent box cap 33 may be mounted on the upper side of the detergent box body 31 to cover upper sides of the bleacher retaining part 31C and the softener retaining part 31D.

The detergent box cap may also have input holes 33A for inputting the bleacher and the softener to the bleacher retaining part and the softener retaining part, respectively. A siphon cap 35 capping siphon pipe 34 may protrude downward from a bottom of the detergent box cap, to allow input bleacher and softener to be discharged from bleacher retaining part 31C and softener retaining part 31D due to a siphon phenomenon.

Referring to FIG. 2, dispenser 20 includes a first withdrawal protrusion 26 protruding inwardly from front and lower surfaces of the bottom panel 24, and the detergent box 30 includes a second withdrawal protrusion 36 protruding from an upper surface of the detergent box cap 33, to be caught by the first withdrawal protrusion 26 when the detergent box 30 is withdrawn. The second withdrawal protrusion can be controlled in terms of its height to avoid interference with the first withdrawal protrusion.

W withdrawal distance of the detergent box 30 may therefore be set by the first and second withdrawal protrusions 26 and 36. If desired, the second withdrawal protrusion may be controlled in terms of its height to avoid being caught by the first withdrawal protrusion, to thereby allow detergent box 30 to be completely disengaged from dispenser 20. Additionally, or alternately, the first and second withdrawal protrusions may be provided in various positions, so that they correspond to an inner surface of the dispenser and an outer surface of the detergent box.

Referring to FIGS. 2 and 3, the dispenser 20 includes a first insertion protrusion 28 which protrudes inwardly from an inner surface thereof, and the detergent box 30 includes a second insertion protrusion 38 which protrudes from an outer surface thereof and catches the first insertion protrusion 28 upon insertion and releases the first insertion protrusion 38 upon withdrawal. The first and second insertion protrusions may have slanted surfaces along the withdrawal and insertion directions of the detergent box.

Accordingly, when the detergent box is inserted into the dispenser, the second insertion protrusion 38 is caught and rides over the first insertion protrusion 28 extending to the rear. And, when the detergent box is withdrawn from the dispenser, the second insertion protrusion 38 releases and rides over the first insertion protrusion 28 and extends to the front.

Figure 4:
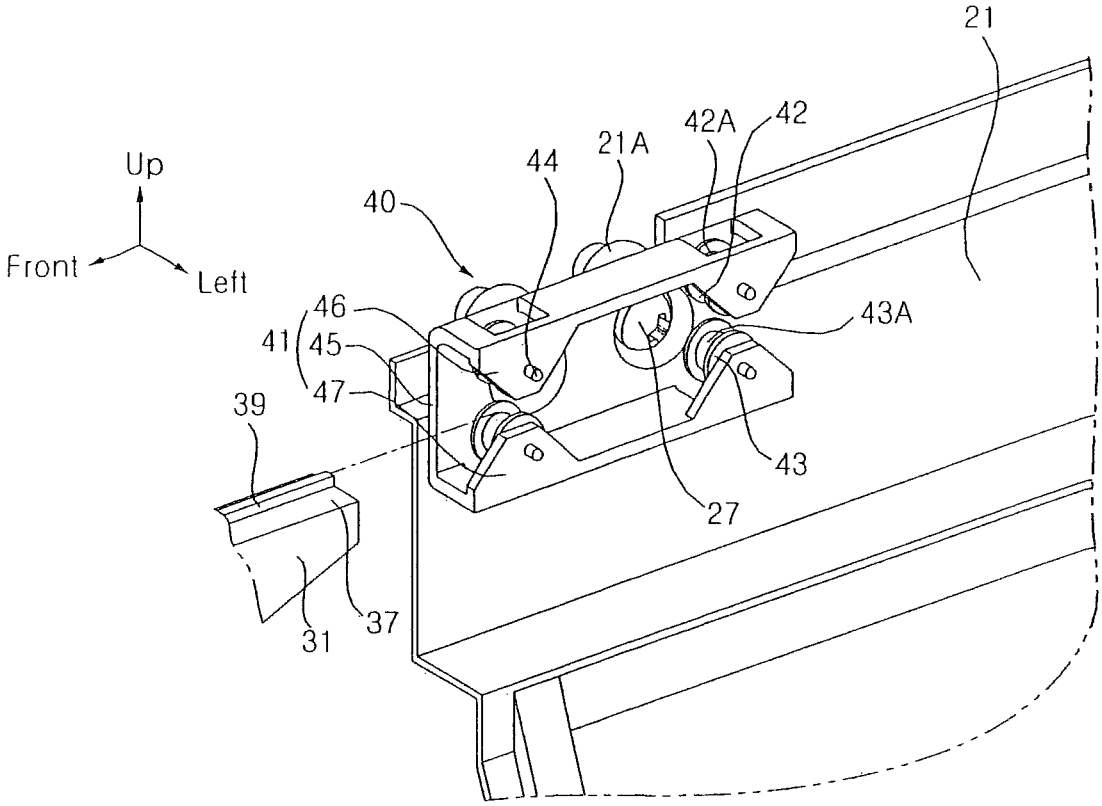
FIG. 4 is an exploded view of various parts shown in FIG. 3.
Figure 5:
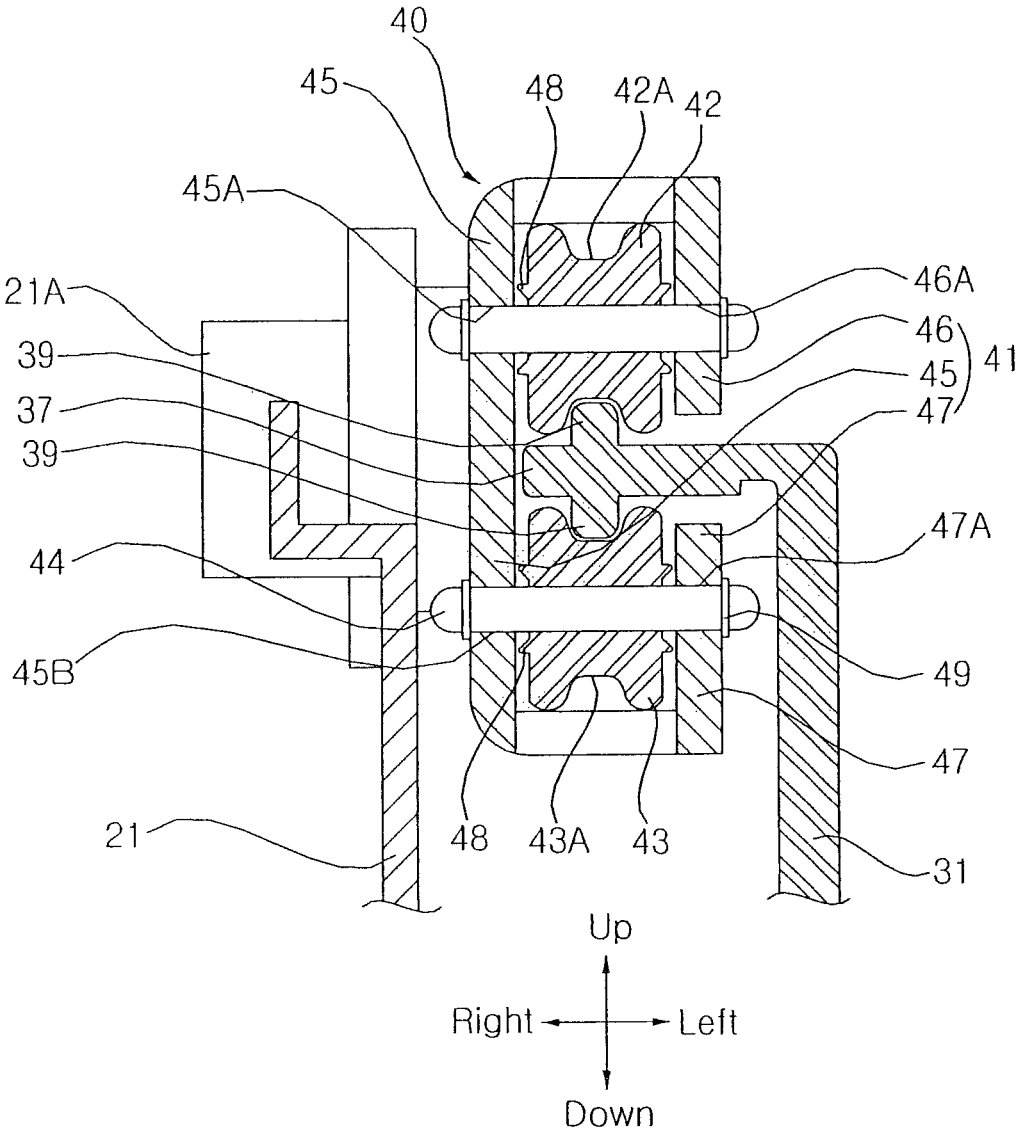
FIG. 5 is a cross-sectional view taken along section line A-A in FIG. 3.
Figure 6:
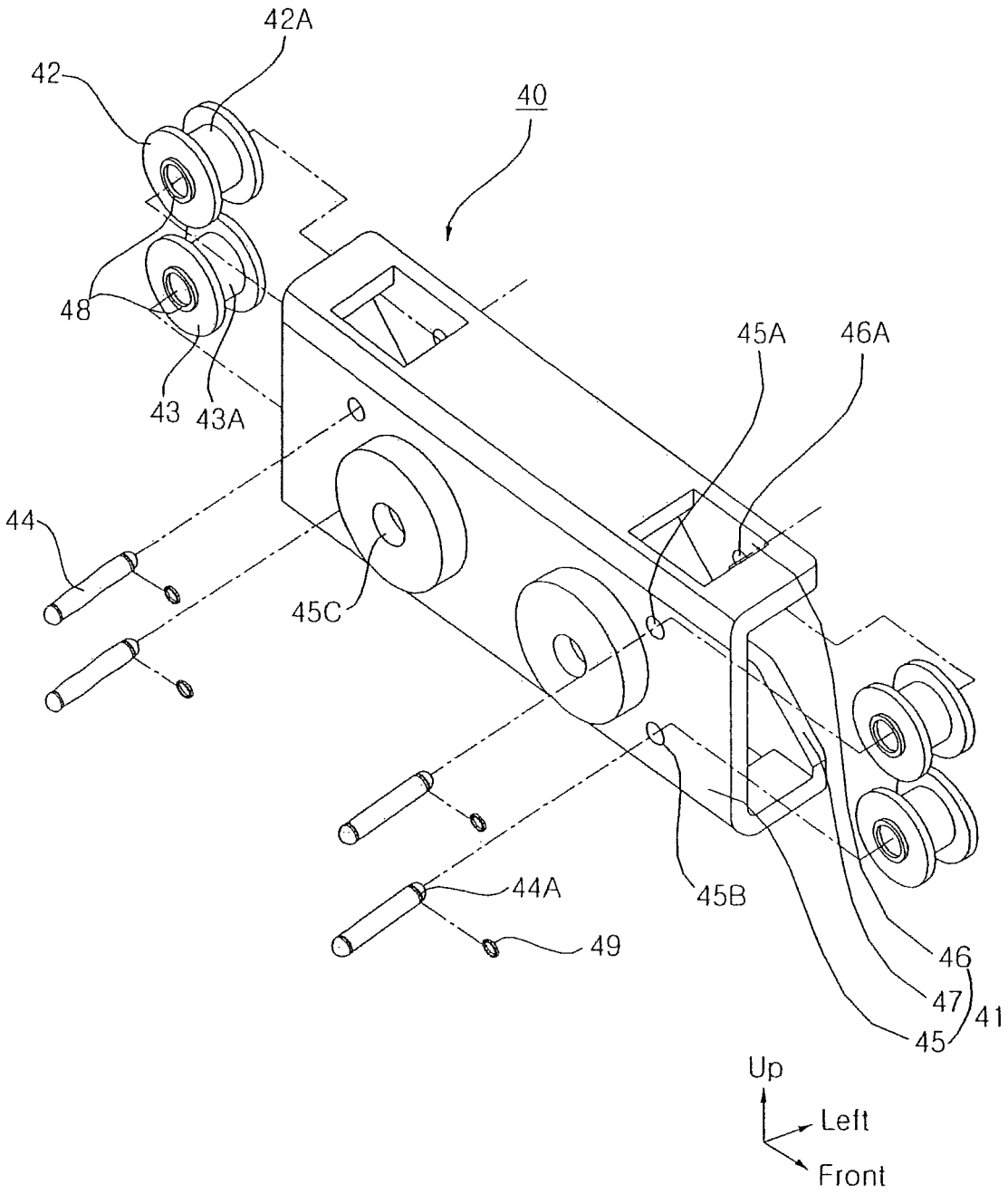
FIG. 6 is an exploded view of a guide unit shown in FIG. 3.

Referring to FIGS. 4 to 6, the guide unit 40 supports flange part 37 of the detergent box in a roll-and-contact method, for example, by supporting upper and lower sides of the flange part. Alternately, the guide unit may support only one of the upper side or lower side of the flange part. To perform its supporting function, the guide unit includes a support frame 41 mounted at respective inner surfaces of dispenser 20, a pair of rollers 42 and 43 provided at upper and lower sides of the flange part for contacting the support frame 41 interposed therebetween, and roller connectors 44 each connecting rollers 42 and 43 to the support frame 41. A similar guide unit may be provided on an opposing side of the dispenser.

The support frame 41 includes a mounting part 45, an upper support 46, and a lower support part 47. The mounting part is provided at side and inner surfaces of the dispenser housing 21 and rotatably supports one side of the roller connector 44. The upper support part 46 and lower support part 47 are provided at upper and lower sides of the mounting part 45, and rotatably support sides of the roller connector 44.

The mounting part 45 further includes a coupling hole 45C coupled, by a coupling member 27, to a coupling part 21A provided on a side part of the dispenser housing 21, and first through-holes 45A and 45B provided at upper and lower sides to rotatably receive one end of the roller connectors 44. The upper support part 46 has a structure which horizontally extends from a bottom of the mounting part 45 to an inner side of the dispenser housing 21, and then is bent downwardly. The lower support part 47 has a structure which horizontally extends from a bottom of the mounting part 45 to the inner side of the dispenser housing 21, and then is bent upwardly.

Ends of the upper support part 46 and lower support part 47 are spaced (up/down) apart from each other by a height sufficient to allow the flange part 37 to be inserted. The upper and lower support parts have second through-holes 46A and 46B provided relative to the first through-holes 45A and 45B, respectively, to allow other-ends of the roller connectors 44 to be rotatably inserted.

The rollers include upper roller 42 and a lower roller 37. The upper roller is located between mounting part 45 and upper support part 46 and contact an upper surface of flange part 37. The lower roller 43 is located between mounting part 45 and lower support part 47 to contact a lower surface of the flange part. The upper and lower rollers are provided at the support frame 41, such that two pairs are spaced apart from each other in the direction in which the detergent box 30 moves. In alternative embodiments, upper and lower rollers may be provided in two or more pairs.

Referring to FIGS. 4 and 5, fitting protrusions 39 are provided on upper and/or lower surfaces of flange part 37 in the movement direction of the detergent box 30. Fitting grooves 42A and 43A are provided on circumferential surfaces of rollers 42 and 43. The fitting protrusions are long and are provided in succession in the length direction of the flange part 37. The fitting grooves 42A and 43A are provided in succession along circumferences of the circumferential surfaces of the rollers 42 and 43. The fitting protrusions are coupled to respective ones of the fitting grooves. Alternately, fitting protrusion 39 may be provided on only one of the upper or lower surfaces of the flange part.

Also, fitting groove 42A or 43A can be provided on only the upper roller 42 or the lower roller 43, in a manner which corresponds to fitting protrusion 39. Interference prevention parts 48 protrude from side surfaces of the rollers 42 and 43 such that they do not interfere with support frame 41, and may also be spaced a predetermined distance apart from each other. The interference prevention part includes a circular rib 48 which protrudes a predetermined radius around a rotation center of roller 42 or 43.

Referring to FIG. 6, a roller connector includes rotary shafts 44 which fit into and pass through shaft holes at the rotation center of rollers 42 and 43 respectively. The rotary shafts are fitted into first through-holes 45A and 45B and the second through-holes 46A and 46B to allow the rotary shafts 44 to rotate at both ends. The rotary shafts may have coupling grooves 44A which couple snap rings 49 thereto, and may be provided at both ends along the circumference thereof such that rotary shafts 44 are prevented from releasing from the first through-holes 45A and 45B and the second through-holes 46A and 46B. The snap ring 49 may be, for example, any one of a 'C'-ring, an 'O'-ring, and an 'E'-ring.

Operation of the drum-type washing machine according to one embodiment will now be described. First, a user puts laundry into drum 5 through laundry opening 8A and closes door 11. The user then puts powder detergent, bleacher, and softener into detergent retaining parts 31A, 31B, 31C, and 31D of the detergent box 30, sets a washing course by manipulating control panel 12, and activates the washing machine.

Upon activation, water and detergent are supplied to tub 4 using water supplying unit 13 and detergent supplying unit 14. More specifically, the water supplying unit 13 opens the water supply valve 13B and supplies water to the tub via the water supply hose 13A and the water supply bellows 13C. The detergent supplying unit 14 squirts the water introduced into the water supply hose 13A, to the first and second powder detergent retaining parts 31A and 31B or the bleacher retaining part 31C of the detergent box 30, via the water supply hole 24B of the dispenser cover 22. At this time, the powder detergent or bleacher of the detergent box 30 is washed away by the water squirted from the water supply hole 24B to the bottom of the dispenser housing 21, and is supplied into the tub via the water supply bellows 13C connected to the dispenser housing 21.

Next, the powder detergent and bleacher are supplied to the tub by the water supplying unit 13 and the detergent supplying unit 14, and the drum is rotated by motor 7. As the drum rotates, laundry is lifted by lifter 6 and falls down and laundry washing is implemented.

Upon completion of a wash cycle, the motor is stopped and the wash water is discharged from the tub by the water discharging unit. Water is again supplied to the tub to a predetermined level using the water supplying unit 13, and the drum is again rotated by the motor thereby implementing laundry rinsing. At this time, the detergent supplying unit 14 supplies water to the softener retaining part 31D of the detergent box, and supplies the softener of the softener retaining part 31D into the tub.

Upon completion of a laundry rinse cycle, the wash water is discharged using the water discharging unit. When water discharge is executed in the wash cycle and rinse cycle, a dehydration cycle in which the drum is rotated by the motor at high speed is implemented, thereby removing wash water from the laundry at the time of the dehydration cycle.

After the detergent box is withdrawn outside the dispenser, detergent is input to the detergent retaining parts 31A, 31B, 31C, and 31D, and the detergent box is inserted into the dispenser. The flange part 37 of the detergent box is smoothly and softly supported by rollers 42 and 43 of the guide unit 40 mounted on the dispenser housing 21, according to a roll-and-contact method. Sensitivity reduction and noise generation caused by friction of the detergent box are therefore prevented when the detergent box is withdrawn or inserted, because the flange part smoothly and softly move on its upper surface and lower surface in the front-rear direction using upper roller 42 and lower roller 43 of the guide unit.

The fitting protrusions 39 on the upper and lower surfaces of the flange part move within fitting grooves 42A and 43A on rollers 42 and 43 of the guide unit. The fitting protrusions are fitted to the fitting grooves and thus the flange part is hindered from moving left or right. Movement of the detergent box is therefore stably guided by the guide unit only in the front and rear directions in which the detergent box is withdrawn and inserted.

When the detergent box is withdrawn from opening 20A of the dispenser by a predetermined distance or more, first withdrawal protrusion 26 of dispenser cover 22 catches the second withdrawal protrusion 36 of the detergent box cap 33. As a result, withdrawal of the detergent box stops. In other words, the second withdrawal protrusion 36 and the first withdrawal protrusion 26 automatically limit a maximum distance which the detergent box 30 can be withdrawn.

Powder detergent is input to each of the first and second powder detergent retaining parts 31A, 31B, 31C, and 31D, bleacher is input to the bleacher retaining part 31C, and softener is input to the softener retaining part 31D. If desired, when the second withdrawal protrusion 36 is pressed down and released from the first withdrawal protrusion 26, the detergent box can be disengaged from the dispenser, thereby facilitating replacement and washing of the detergent box with simplicity and convenience.

Next, the first insertion protrusion 28 of the dispenser cover catches the second insertion protrusion 38 of the detergent box body 31 when the detergent box is inserted into opening 20A of the dispenser. The second insertion protrusion rides over the first insertion protrusion 28 when the detergent box keeps being pushed to the rear. This prevents the detergent box from being arbitrarily released from the dispenser due to external impact or vibration, thereby securing use stability of the drum-type washing machine. On the other hand, when the user pulls the detergent box out to withdraw the detergent box, the second insertion protrusion 38 rides over the first insertion protrusion 28, thereby making it possible to withdraw the detergent box 30.

Figure 7:
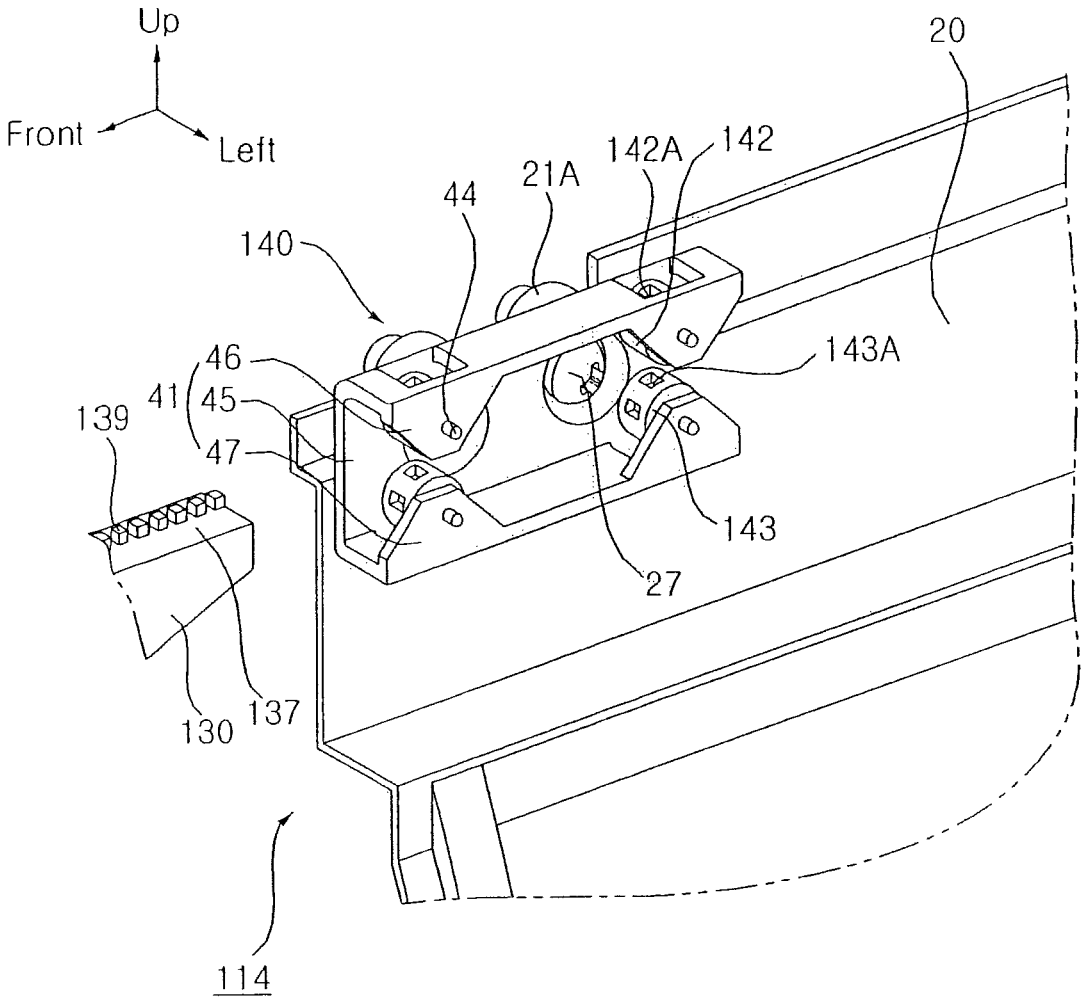
FIG. 7 is a perspective view of another embodiment of a detergent box and dispenser housing that may be included in a drum-type washing machine.

FIG. 7 shows another embodiment of a detergent supplying unit 114 of a drum-type washing machine. This embodiment has a different construction from the detergent supplying unit 14 shown in FIG. 2.

In the detergent supplying unit 114 of FIG. 7, a plurality of fitting protrusions 139 are provided on a flange part 137 of the detergent box 130. The fitting protrusions are spaced an equal distance from each other in the length direction. A plurality of fitting grooves 142A and 143A are provided corresponding to the fitting protrusions 139 along circumferences of rollers 142 and 143 of a guide unit 140 and are spaced from each other.

More specifically, the plurality of fitting protrusions 139 are provided on upper and lower surfaces of the flange part, such that they are spaced a predetermined distance from each other in a movement direction of the detergent box 130. The plurality of fitting grooves 142A and 143A, for fitting with protrusions 139, are provided on circumferential surfaces of rollers 142 and 143. Accordingly, fitting protrusions 139 are sequentially inserted into and released from fitting grooves 142A and 143A of rollers 142 and 143 when the detergent box moves. Fitting protrusions 139 and fitting grooves 142A and 143A, therefore, not only prevent flange part 137 from moving left or right, but also accurately control a front and rear movement distance of the flange part.

Figure 8:
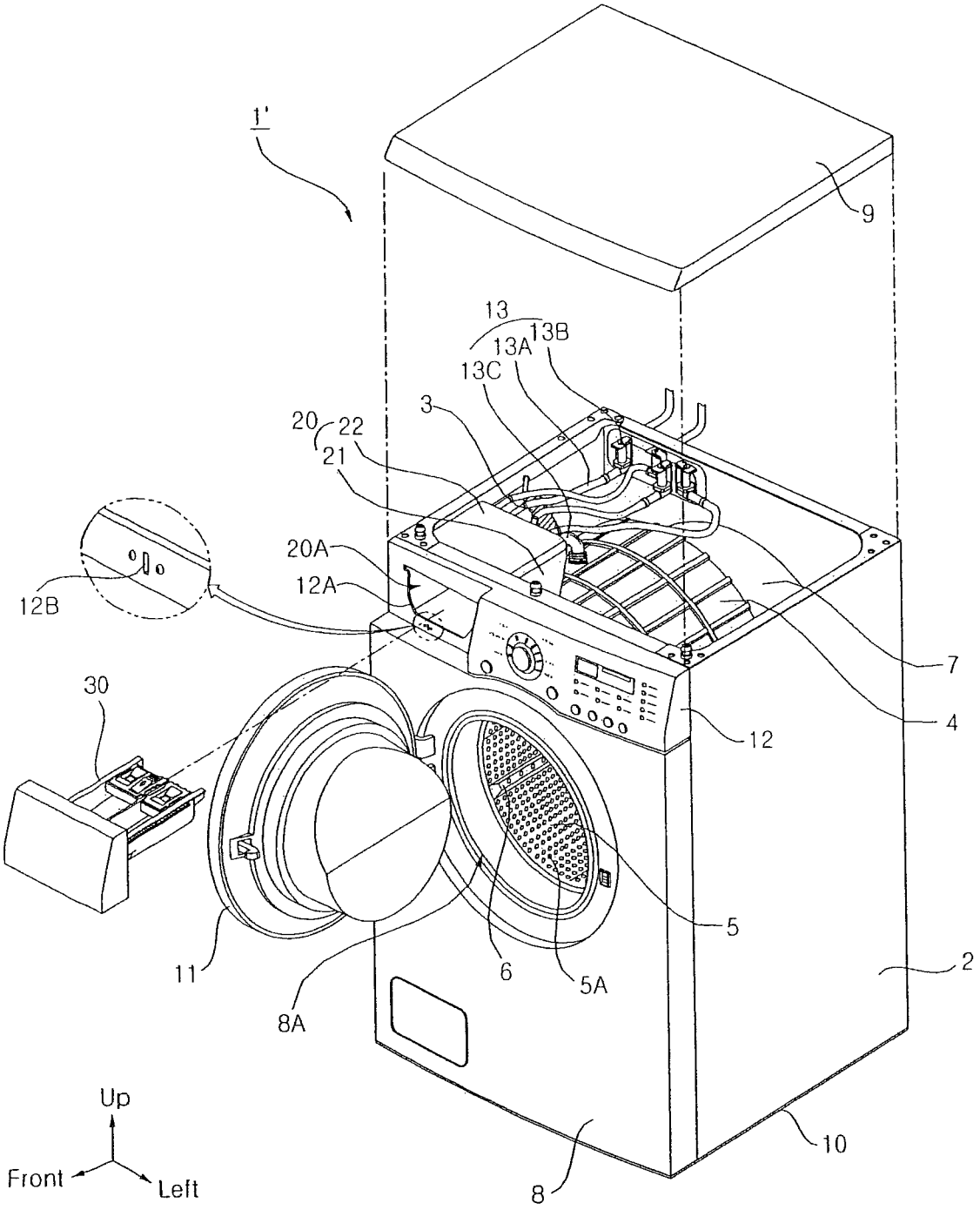
FIG. 8 is a partial view of another embodiment of a drum-type washing machine.

FIG. 8 shows another embodiment of a drum-type washing machine 1'. Washing machine 1' is different from washing machine 1 of FIG. 1 in that washing machine 1' further includes: a locking unit 50 for locking or unlocking the detergent box within dispenser 20, an automatic withdrawing unit 60 for elastically withdrawing the detergent box when locking unit 50 unlocks the detergent box, and a damping unit 70 for limiting a movement speed of the detergent box when the detergent box is withdrawn.

Figure 9:
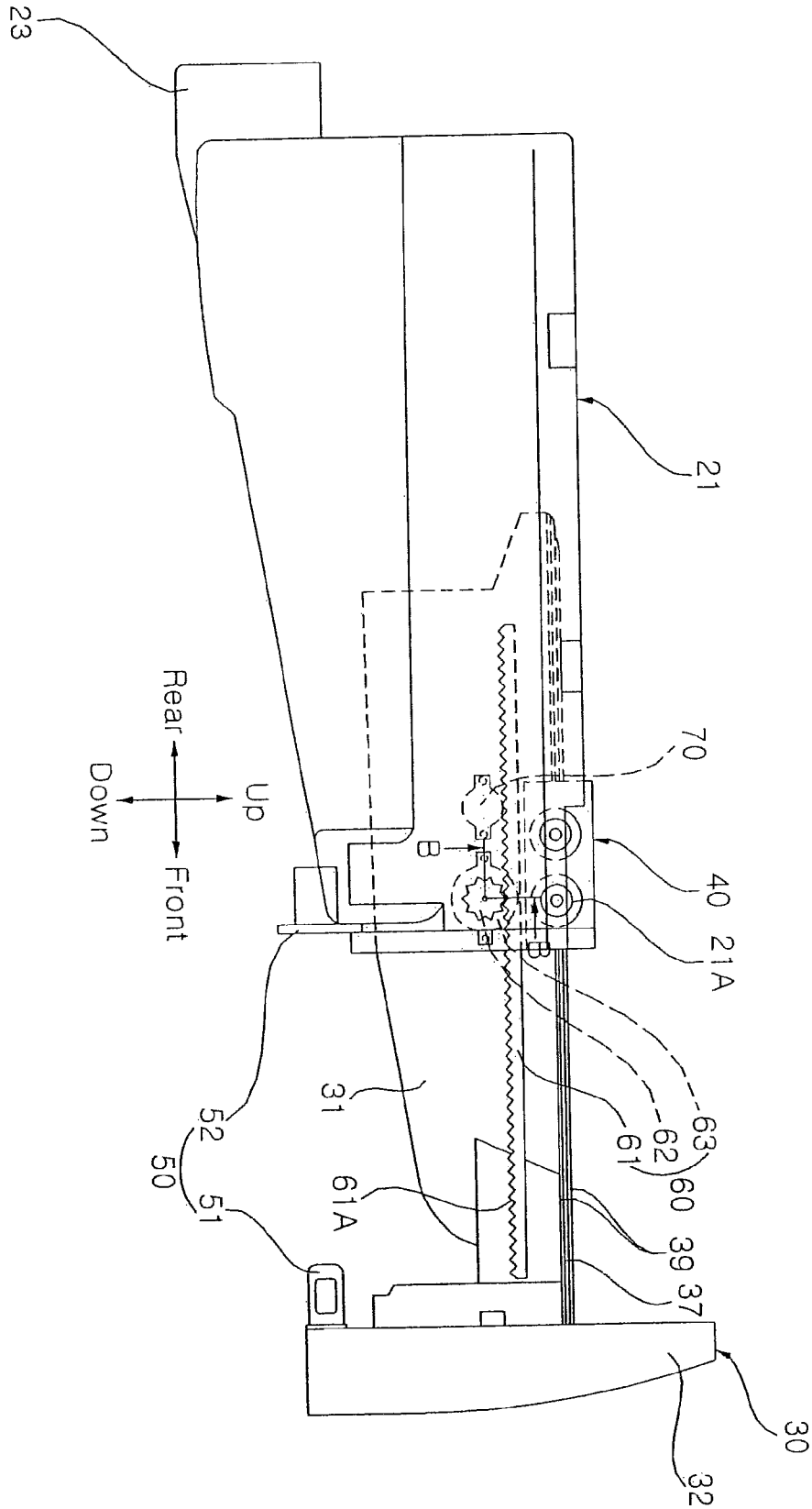
FIG. 9 is a side view of another embodiment of a detergent box and dispenser housing of a drum-type washing machine.

Referring to FIGS. 8 and 9, the locking unit 50 is provided at the dispenser and the detergent box, such that it locks the detergent box when the detergent box 30 is inserted into the dispenser 20 and unlocks the locked detergent box when the locked detergent box again moves into the dispenser. The locking unit includes a locking hook 51 provided at the detergent box and a toggle switch 52 at the dispenser or a control panel 12, for repeatedly locking and unlocking the locking hook 51 as the locking hook 51 is inserted. The locking hook is mounted at a lower side and on a rear surface of a front panel 32 of detergent box 30.

The toggle switch 52 is provided at a lower side of the dispenser housing 21, at a location which corresponds to the locking hook 51. The toggle switch has an insertion groove at its center for receiving an end of locking hook 51 therein. The toggle switch is provided on a rear surface of the control panel such that the insertion groove matches an insertion hole 12B provided at a lower side of a doorway hole part 12A of the control panel.

Alternately, the toggle switch may be directly provided at a lower side in front of the dispenser housing 21, such that the insertion groove matches insertion hole 12B. Here, first insertion protrusion 28 and second insertion protrusion 38 described in the aforementioned embodiment may be omitted because locking unit 50 does not move the detergent box to the front upon insertion.

Figure 10:
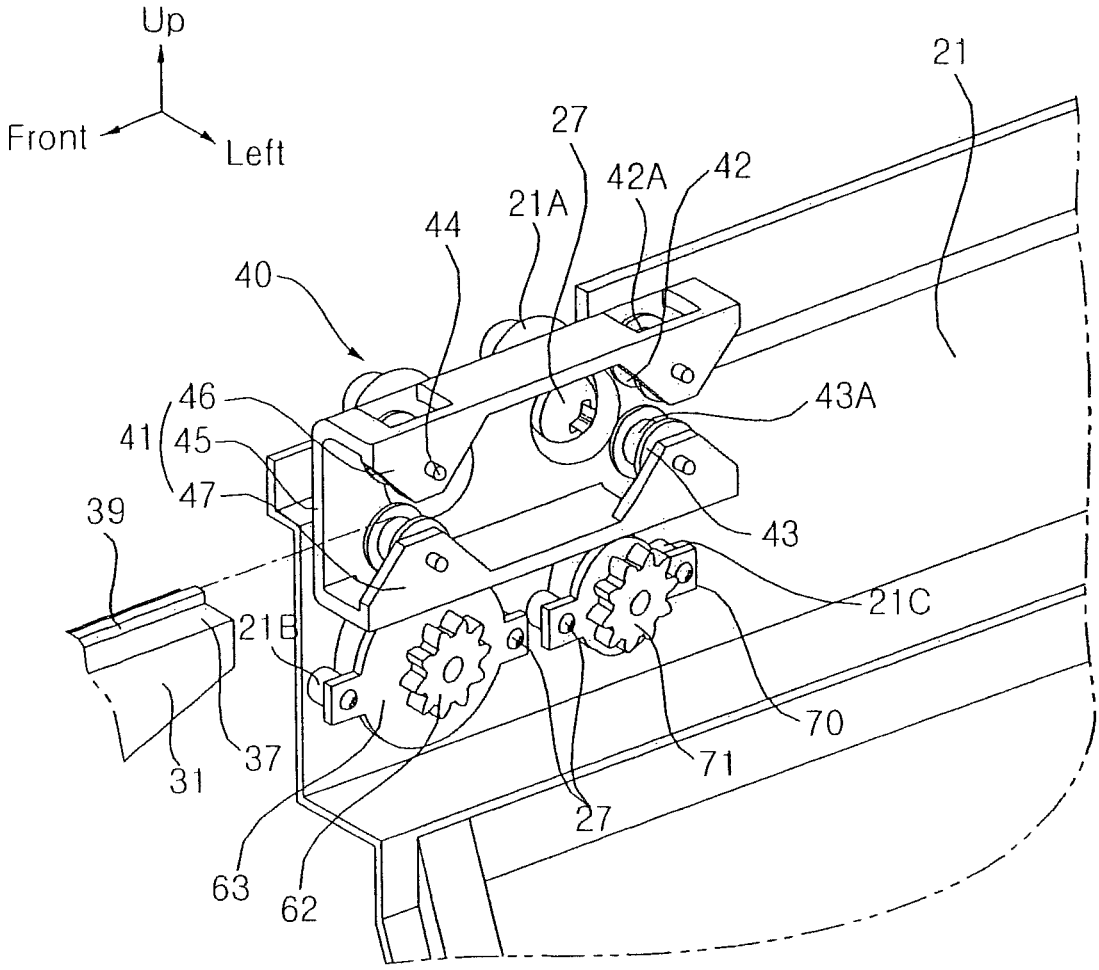
FIG. 10 is a partial view of various parts shown in FIG. 9.

Referring to FIGS. 9 and 10, the automatic withdrawing unit 60 includes: a rack gear part 61 at a side part of the detergent box 30; a withdrawing pinion gear 62 geared with the rack gear part 61; and an elastic member 63 at a side part of the dispenser 20 for connecting the withdrawing pinion gear 62 to elastically rotate the withdrawing pinion gear 62 in the withdrawal direction of the detergent box 30 when the locking unit 50 unlocks. In the automatic withdrawing unit 60, the rack gear part 61 can be provided at the dispenser 20, and also the elastic member 63 can be provided at the detergent box 30.

Referring to FIG. 9, the rack gear part 61 may be long and provided on an outer and side surface of a detergent box body 31 along the movement direction of the detergent box 30. A gear part 61A is provided at a lower part of the rack gear part 61 and meshes with the withdrawing pinion gear 62.

Figure 11:
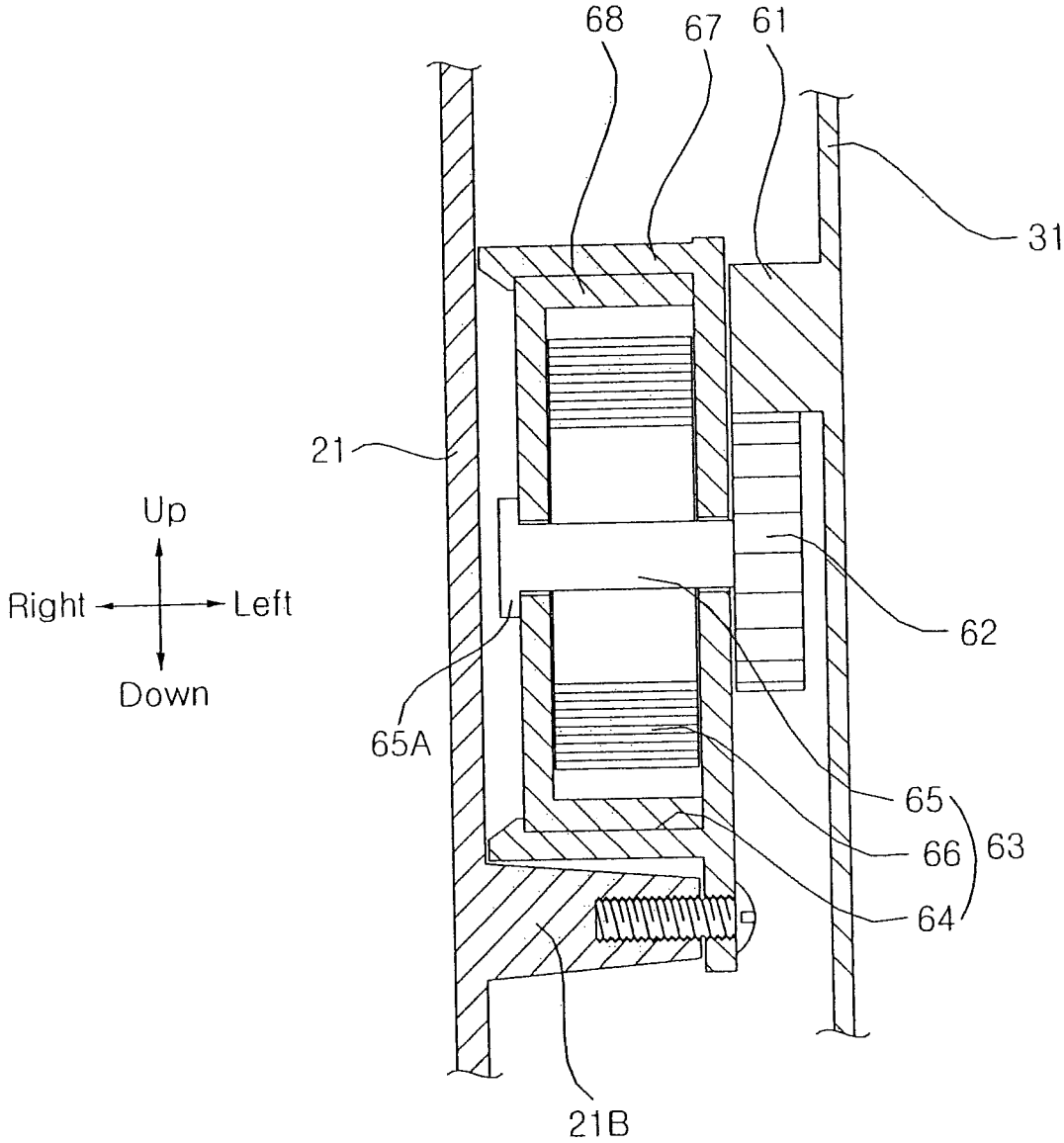
FIG. 11 is a cross-sectional view taken along section line B-B in FIG. 9.

Referring to FIG. 11, elastic member 63 includes: a housing part 64 mounted on a side part of the dispenser housing 21; a rotary shaft 65 rotatably provided within the housing part, for connecting one side with the withdrawing pinion gear; and an elastic body 66 connected at both ends to the other side of the rotary shaft 65 and housing part 64. The housing part may have a tank shape with an internal void space for housing the elastic body 66. The housing part 64 is coupled to a coupling boss 21B at the side part of the dispenser housing 21, using a coupling member 27. Alternatively, the housing part can be provided at the side part of the dispenser housing 21 by a hook and a hook hole, an adhesive, or fusion.

Both ends of rotary shaft 65 are provided to pass through side surfaces of housing part 64 and are rotatably supported. The rotary shaft connects at one end to the withdrawing pinion gear and may have a stepped stopper 65A at the other end to prevent disengagement from the rotary shaft. The elastic body 66 may include a spiral spring 66 in a shape which surrounds the rotary shaft within the housing part, and for connecting at both ends to the rotary shaft and housing part 64.

Referring to FIGS. 9 and 10, the damping unit 70 may include rotary dampers 70. Each damper may be provided at a respective side part of the dispenser housing 21 of the dispenser and may have damping pinion gears 71 that mesh with the rack gear parts 61. In other words, damping pinion gear 71 of the rotary damper may be mesh with the rack gear part 61, such that the damping pinion gear damply rotates while limiting movement speed of the rack gear part when the detergent box moves. The rotary damper is coupled and fixed to the coupling boss 21C provided at the side part of the dispenser housing, using coupling member 27. However, the rotary damper 70 can be provided at the side part of the dispenser housing 21, for example, by a hook and a hook hole, an adhesive, or fusion.

Operation of detergent box 30 of the washing machine 1' will now be described. First, the detergent box is withdrawn when a user pushes the front panel 32 of the detergent box with slight force. At this time, the detergent box is inserted into dispenser 20, inside the doorway hole part 12A of the control panel. The applied force is then removed from the front panel 32.

At this time, if the detergent box 30 is locked, locking unit 50 slightly moves to the rear and locking hook 51 of the detergent box 30 slightly moves to the rear within the insertion groove of toggle switch 52, thereby unlocking locking hook 51 and toggle switch 52. The elastic force of the elastic member 63 induces rotation of the withdrawing pinion gear 62, and the withdrawing pinion gear enables movement of rack gear part 61 to the front. Thus, the detergent box is allowed to be withdrawn frontwardly from the doorway hole part of the control panel.

The locking hook 51, thus, escapes from the insertion groove of the toggle switch 52 and insertion hole 12B of the control panel. If the detergent box 30 is withdrawn frontwardly by a predetermined distance or more, the first withdrawal protrusion 26 of the dispenser cover 22 catches the second withdrawal protrusion 36 of the detergent box cap 33, and thus withdrawal of the detergent box 30 stops.

If the rack gear part 61 moves upon the withdrawal of the detergent box 30, the damping pinion gear 71 rotates and meshes with the tack gear part 61. Accordingly, the detergent box is prevented from sudden movement and is allowed to be slowly withdrawn. At this time, a damping action of the rotary damper 70 limits a withdrawal speed of the detergent box.

The detergent box is inserted when a user pushes the detergent box into the dispenser 20 until the front panel 32 contacts the doorway hole part 12A of the control panel. If the detergent box is inserted into to the rear, the detergent box body 31 of the detergent box is inserted into the dispenser and the locking hook 51 is inserted into the insertion hole 12B. If the front panel 32 of the detergent box contacts the doorway hole part 12A, the locking hook passing through insertion hole 12B is inserted into the insertion groove and is locked by the toggle switch 52. In the same manner as when the detergent box is withdrawn, the detergent box is prevented from sudden movement by the rotary damper 70 and is inserted slowly.

Accordingly, the detergent box is not only improved in terms of its convenience of use, but also provides allowed to be automatically withdrawn by the automatic withdrawing unit 60 or to be inserted only by action of pressing the detergent box inside the doorway hole part of the control panel. Damage and impact noise caused by sudden withdrawal and insertion of the detergent box are therefore prevented, because withdrawal and insertion of the detergent box is smoothly and slowly implemented using the damping unit.

The detergent box can be released from dispenser 20 by pressing downward the second withdrawal protrusion 36 to avoid a state where it is caught by the first withdrawal protrusion 26. The detergent box can therefore be replaced and washed with simplicity and convenience.

One or more embodiments described herein relate to a washing machine for facilitating withdrawal and insertion of a detergent box, and for improving the use of the detergent box in terms of convenience. The embodiments described herein may also prevent noise generation caused by friction when the detergent box is withdrawn and inserted from a dispenser.

According to one embodiment, the washing machine includes a dispenser, a detergent box, and guide units. The dispenser has an opening. The detergent box is provided to be movable within the dispenser through the opening, and has flange parts provided at its both sides in a movement direction thereof. The guide units are provided on inner surfaces of both side parts of the dispenser to movably support the flange parts when the detergent box is withdrawn or inserted.

The guide unit may support the flange part in a roll and contact method. The guide unit may support at least any one of an upper side and a lower side of the flange part. The guide unit may include support frames, a roller, and a roller connector. The support frames may be provided on the inner surfaces at the both side parts of the dispenser. The roller may be provided at least any one of an upper side and a lower side of the support frame, and supporting the flange part. The roller connector may rotatably connect the roller to the support frame.

The support frame may include a mounting part, and a support part. The mounting part may be provided on an inner surface oft a side part of the dispenser, and may rotatably support one side of the roller connector. The support part may protrude from the mounting part, and may rotatably support the other side of the roller connector. The roller may be provided in plurality at the support frame in the movement direction of the detergent box. The flange part may have a fitting protrusion provided in a length direction on a surface contacting with the roller. The roller may have a fitting groove for fitting the fitting protrusion.

The fitting protrusions may be provided to extend in the length direction of the flange part, and the fitting grooves may be provided to extend along a circumferential surface of the roller. Alternately, the fitting protrusions may be provided in plurality to be spaced apart from each other in the length direction of the flange part, and the fitting grooves may be provided in plurality to be spaced apart from each other correspondingly to the fitting protrusions along a circumferential surface of the roller.

Interference prevention parts may protrude from both side surfaces of the roller to be spaced apart from the support frame in order not to interfere from the support frame. The roller connector may include a rotary shaft connecting to a rotation center of the roller, and the interference prevention part may include a circular rib provided centering on a portion connecting with the rotary shaft.

The dispenser may include a first insertion protrusion protruding inward, and the detergent box may include a second insertion protrusion provided at a portion corresponding to the first insertion protrusion, and caught by the first insertion protrusion upon insertion and released from the first insertion protrusion upon withdrawal. The first insertion protrusion and the second insertion protrusion may be provided to have slant surfaces along a withdrawal direction and an insertion direction of the detergent box.

The washing machine may further include a locking unit for locking or unlocking the detergent box inserted into the dispenser, and an automatic withdrawing unit for elastically withdrawing the detergent box when the locking unit unlocks.

The locking unit may be provided at the dispenser and the detergent box such that it locks the detergent box when the detergent box is inserted into the dispenser, and unlocks the locked detergent box when the locked detergent box again presses into the dispenser. The automatic withdrawing unit may include a rack gear part provided at least one of the detergent box and the dispenser, a pinion gear geared with the rack gear part, and an elastic member provided at the other one of the detergent box and the dispenser, and connecting with the pinion gear to elastically rotate the pinion gear in a withdrawal direction of the detergent box when the locking unit unlocks. The elastic member may include a housing part provided at the dispenser housing or the dispenser, a rotary shaft rotatably provided within the housing part, and connecting at one side with the pinion gear, and an elastic body connecting at its both ends to the other side of the rotary shaft and the housing part.

The washing machine may further include a damping unit for limiting a withdrawal speed of the detergent box. The damping unit may include a rotary damper provided at the dispenser or the detergent box where the rack gear part is not provided, and having a pinion gear geared to the rack gear part.

The dispenser may include a first withdrawal protrusion protruding inward. The detergent box may include a second withdrawal protrusion provided at a portion corresponding to the first withdrawal protrusion and controlled in height such that it is caught by the first withdrawal protrusion and sets a withdrawal distance and such that it avoids interference from the first withdrawal protrusion and is disengaged from the dispenser.

As described above, the washing machine has an advantage that the detergent box is easily withdrawn or inserted using the guide unit, thereby improving use convenience.

Also, the washing machine has an advantage that when the detergent box is withdrawn or inserted, the guide unit reduces a friction resistance of the detergent box, thereby improving a sense of use and preventing noise generation caused by the friction.

The embodiments described herein may be varied in many ways. For example, in addition to drum-type washing machines, the embodiments are applicable to a steam-type washing machine or a dish washing machine having detergent boxes for holding detergent. Also, the locking and damping units may be applied in various ways besides the above-described exemplary embodiments.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A drawer of a washing machine comprising:

a dispenser having an opening;

a detergent box movable within the dispenser through the opening, and having flanges that extend at sides of the detergent box and a rack gear that extends from one of the sides of the detergent box along a movement direction of the detergent box; and guide units provided on inner surfaces of sides of the dispenser, each guide unit including at least one roller that movably supports a respective one of the flanges, a support frame, and a roller connector that rotatably connects the at least one roller to the support frame, wherein the drawer further comprising:

a lock to lock or unlock the detergent box in the dispenser;

an automatic withdrawer configured to withdraw the detergent box when the lock unlocks the detergent box, wherein the automatic withdrawer includes a first pinion gear meshed with the rack gear;

a damper configured to limit a withdrawal speed of the detergent box, wherein the damper includes a second pinion gear meshed with the rack gear, wherein the second pinion gear is placed at a predetermined distance interval from and aligned with the first pinion gear such that the first pinion gear and the second pinion gear, that are meshed with the rack gear, preventing the detergent box from being shaken when the detergent box is withdrawn or inserted.

2. The drawer of the washing machine of claim 1, wherein the support frame comprises:

a mount, provided on one of the inner surfaces of the sides of the dispenser, to rotatably support one side of the roller connector; and a support, protruding from the mount, to rotatably support another side of the roller connector.

3. The drawer of the washing machine of claim 1, wherein the at least one roller comprises side surfaces and further comprising: an interference preventer that protrudes from each side surface of the at least one roller and that is spaced apart from the support frame in order to not interfere with the support frame.

4. The drawer of the washing machine of claim 3, wherein the roller connector comprises a rotary shaft connected to a rotation center of the at least one roller, and wherein the interference preventer comprises a circular rib which centers on a portion connected to the rotary shaft of the at least one roller.

5. The drawer of the washing machine of claim 1, wherein the dispenser comprises a first insertion protrusion protruding inward, and wherein the detergent box comprises:

a second insertion protrusion at a portion which corresponds to the first insertion protrusion and which is caught by the first insertion protrusion upon insertion and released from the first insertion protrusion upon withdrawal.

6. The drawer of the washing machine of claim 5, wherein the first insertion protrusion and the second insertion protrusion are provided to have slant surfaces along a withdrawal direction and an insertion direction of the detergent box.

7. The drawer of the washing machine of claim 1, wherein the lock is provided at the dispenser and the detergent box, to lock the detergent box when the detergent box is inserted into the dispenser and to unlock the locked detergent box when the detergent box again presses into the dispenser.

8. The drawer of the washing machine of claim 1, wherein the automatic withdrawer further comprises:

an elastic member connecting with the first pinion gear to elastically rotate the first pinion gear in a withdrawal direction of the detergent box when the lock unlocks the detergent box.

9. The drawer of the washing machine of claim 8, wherein the elastic member comprises:

a housing part;

a rotary shaft rotatably provided within the housing part, and connecting at one side with the first pinion gear; and an elastic body connecting at both ends of the elastic body to the other side of the rotary shaft and the housing part.

10. The drawer of the washing machine of claim 1, wherein the dispenser comprises a first withdrawal protrusion protruding inward, and wherein the detergent box comprises:

a second withdrawal protrusion protruding from an upper surface of the detergent box to be caught by the first withdrawal protrusion when the detergent box is withdrawn.

11. The drawer of the washing machine of claim 1, wherein the guide unit includes a plurality of upper rollers and a plurality of lower rollers, wherein the guide unit is disposed above the first and second pinion gears such that the guide unit prevents a weight of the detergent box from being loaded on the first and second pinion gears.

* * * * *